US006943311B2

(12) United States Patent
Miyako

(10) Patent No.: US 6,943,311 B2
(45) Date of Patent: Sep. 13, 2005

(54) SWITCH

(75) Inventor: Mamoru Miyako, Niwa-gun (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/865,107

(22) Filed: Jun. 10, 2004

(65) Prior Publication Data

US 2004/0251120 A1 Dec. 16, 2004

(30) Foreign Application Priority Data

Jun. 12, 2003 (JP) ..... 2003-167677

(51) Int. Cl.[7] ..... H01H 1/10
(52) U.S. Cl. ..... 200/517; 200/339
(58) Field of Search ..... 200/5 A, 5 R, 200/339, 511–517, 553, 561

(56) References Cited

U.S. PATENT DOCUMENTS 4,194,105 A * 3/1980 Hodges ..... 200/517
4,864,085 A * 9/1989 Hanajima et al. ..... 200/5 A
4,952,762 A * 8/1990 Koyanagi ..... 200/517
5,559,311 A * 9/1996 Gorbatoff ..... 200/513
5,655,650 A * 8/1997 Naitou ..... 200/553
5,905,235 A * 5/1999 Charman ..... 200/5 A
5,990,435 A * 11/1999 Chao ..... 200/517
6,288,353 B1 * 9/2001 Chiang ..... 200/512
6,366,275 B1 * 4/2002 Lai ..... 345/168
6,541,724 B2 * 4/2003 Nozawa et al. ..... 200/517

* cited by examiner

*Primary Examiner*—Elvin G. Enad
*Assistant Examiner*—Lisa Klaus
(74) *Attorney, Agent, or Firm*—Mark D. Simpson; Synnestvedt & Lechner LLP

(57) ABSTRACT

A switch that dampens noise that is produced when the switch is operated. The switch includes a wiring board. A resiliently deformable rubber contact is arranged on the wiring board. The rubber contact includes a contact portion for electrically contacting the wiring board when the rubber contact is deformed. A pusher contacts and deforms the rubber contact. A button contacts the pusher when operated. The rubber contact includes an elastic portion that contacts the button before the button contacts the pusher.

10 Claims, 4 Drawing Sheets

SWITCH

BACKGROUND OF THE INVENTION

The present invention relates to a switch, and more particularly, to a switch that uses a rubber contact.

Various types of switches are used in various types of products, such as household appliances and vehicles, in accordance with the required capability and function. Rubber contacts are often used at contact portions in such switches. A rubber contact is advantageous in that it is resilient and thus enables the number of mechanical components, such as springs, to be reduced.

To improve the durability of the rubber contact and the feel of the switch when operated, it is desirable that the top portion of the rubber contact be pushed. FIG. 1 shows a typical switch 30. The switch 30 includes a button 31 having two operated portions, rubber contacts 32, and pushers 33, which are located between the button 31 and the rubber contacts 32. Projections 36 extend from an inner surface of the button 31. When the user pushes one of the operated portions of the button 31, the button 31 is pivoted about a fulcrum X and pushes the pusher 33 with one of the projections 36. This resiliently deforms the associated rubber contact 32 and electrically connects a contact portion 34 of the rubber contact 32 to a wiring board 35, as shown in FIG. 2.

However, in the prior art switch 30, when the button 31 is pushed as shown in the state of FIG. 2, the projection 36 of the button 31 and the pusher 33 produce noise, which is uncomfortable to the user, when coming into contact with each other.

SUMMARY OF THE INVENTION

The present invention provides a switch that dampens noise that is produced when the switch is operated.

The present invention provides a switch including a wiring board and a resiliently deformable rubber contact arranged on the wiring board. The rubber contact includes a contact portion electrically connected to the wiring board when the rubber contact is deformed. A pusher contacts and deforms the rubber contact. An operating body contacts the pusher when operated. The rubber contact includes an elastic portion that contacts the operating body before the operating body contacts the pusher.

A further aspect of the present invention is a switch including a wiring board and a resiliently deformable rubber contact arranged on the wiring board. The rubber contact includes a contact portion electrically connected to the wiring board when the rubber contact is deformed. A pusher contacts and deforms the rubber contact. The pusher includes a contact surface. An operating body contacts the contact surface of the pusher when operated. The rubber contact includes an elastic portion extending from the contact surface toward the operating body to contact the operating body before the operating body contacts the contact surface of the pusher.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A seesaw switch 1 according to a preferred embodiment of the present invention will now be discussed with reference to FIGS. 3 to 7.

Figure 1:
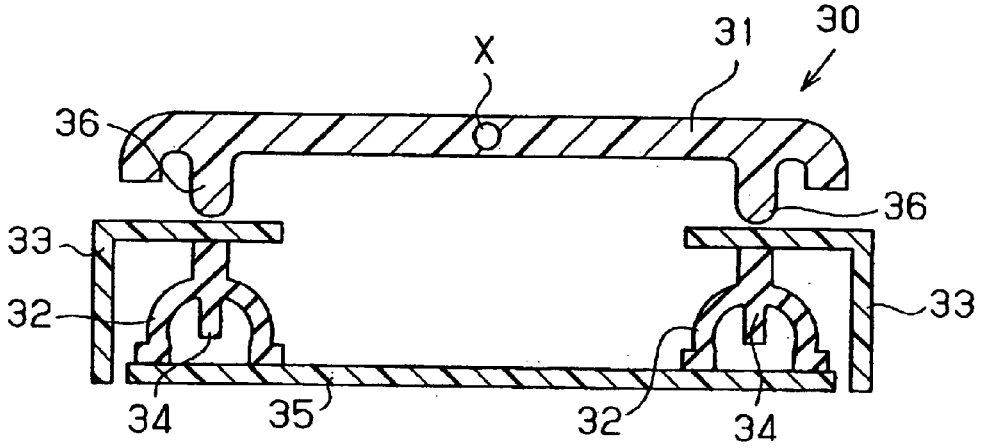
Fig.1 (Prior Art)
FIG. 1 is a cross-sectional view showing a seesaw switch in the prior art.
Figure 2:
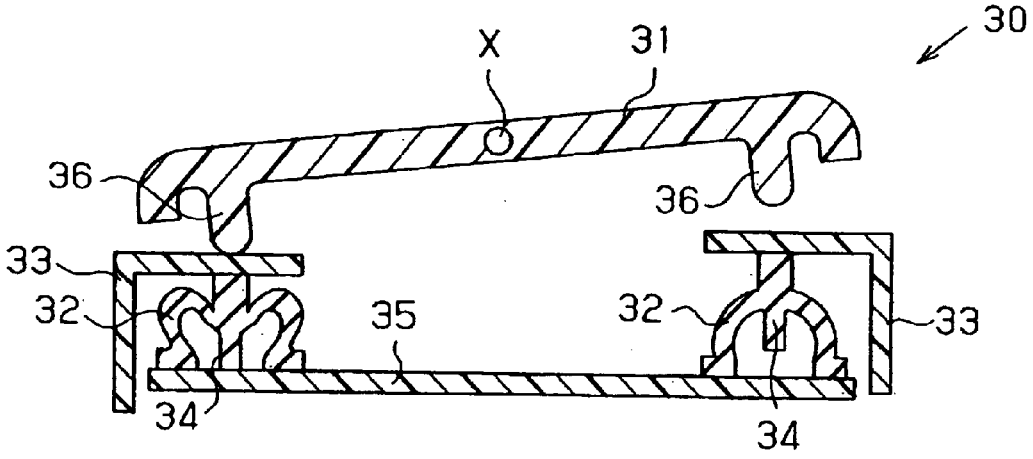
Fig.2 (Prior Art)
FIG. 2 is a cross-sectional view showing the seesaw switch of FIG. 1 when operated.
Figure 3:
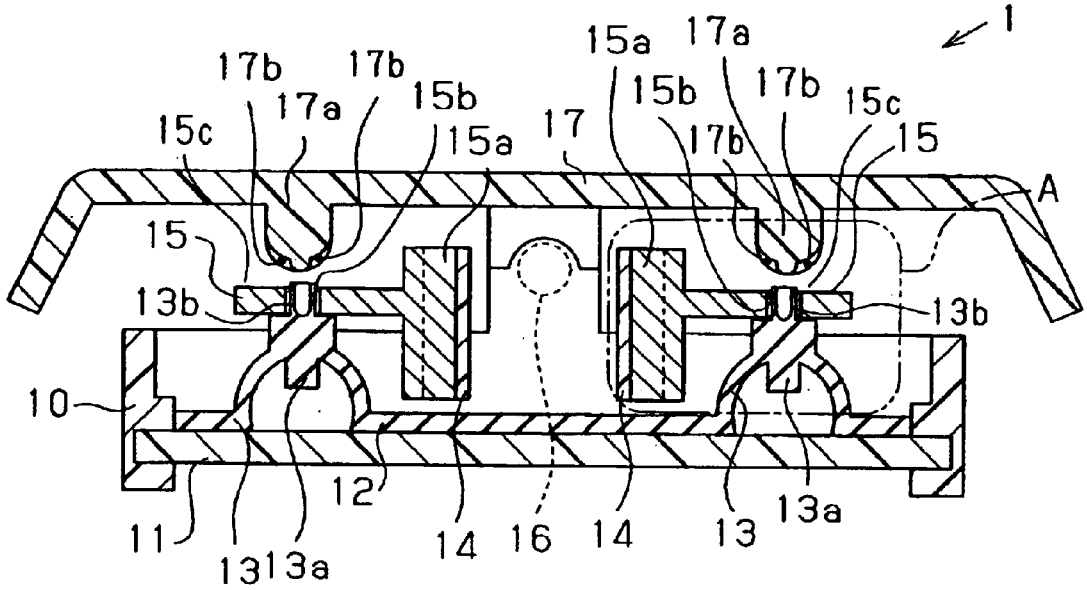
FIG. 3 is a cross-sectional view showing a seesaw switch according to a preferred embodiment of the present invention.
Figure 4:
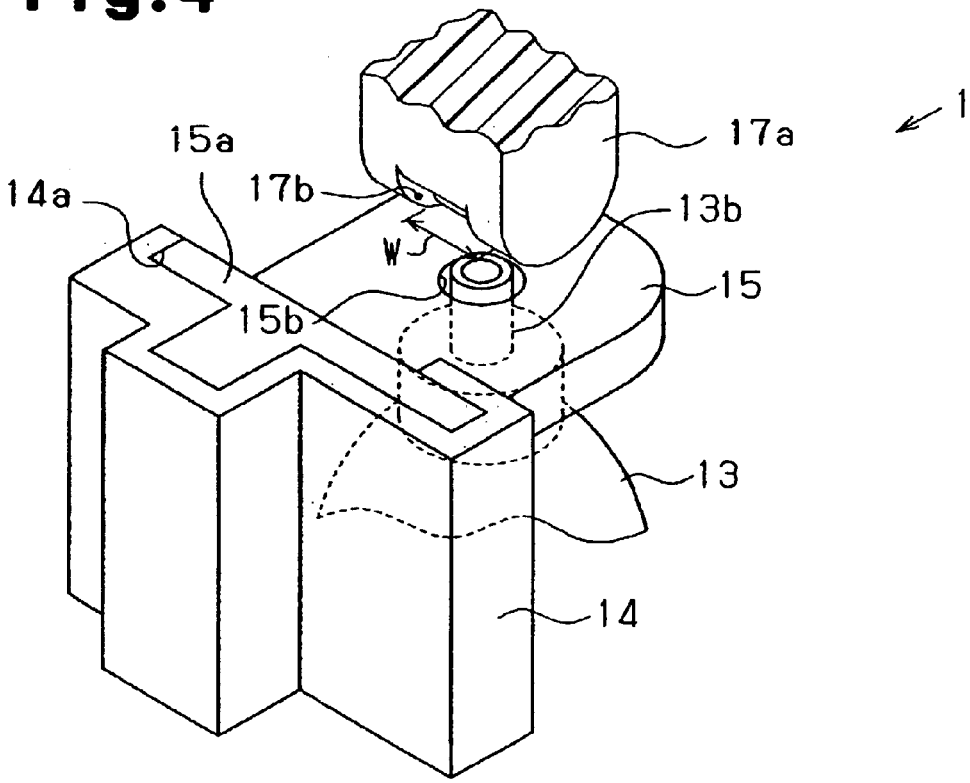
FIG. 4 is an enlarged perspective view showing portion A in the seesaw switch of FIG. 3.

Referring to FIGS. 3 and 4, the seesaw switch 1 includes a case 10, a rubber contact sheet 12, two pushers 15, and a button 17, which functions as an operating body and has two operated portions. A wiring board 11 is accommodated in the case 10 of the seesaw switch 1. Terminals (not shown) are arranged on the wiring board 11. The rubber contact sheet 12 is arranged on the upper surface of the wiring board 11, as viewed in FIG. 3. Two rubber contacts 13 are formed integrally with the contact sheet 12. The rubber contacts 13 are dome-shaped, resiliently deformable, and made of synthetic resin. A contact portion 13*a* is defined at the inner top portion of each rubber contact 13. The pushers 15 are arranged between the button 17 and the rubber contacts 13. Each pusher 15 includes an engaging portion 15*a* and a hole 15*b*.

Two supports 14 are arranged in the middle of the case 10 between the two rubber contacts 13. Each support 14 has a guide portion 14*a* defined by an opening facing towards the associated one of the rubber contacts 13. The guide portion 14*a* is engaged with the engaging portion 15*a* of the associated pusher 15. The engagement enables movement of the pusher 15 in the vertical direction of FIG. 3, or the deformation direction of the rubber contact 13.

A shaft 16 extends across the opening of the case 10. The button 17, which covers the opening of the case 10, is supported by the shaft 16 in an inclinable manner. Two projections 17*a* project from the lower side of the button 17 towards an associated one of the pushers 15. When the button 17 is pushed, one of the projections 17*a* pushes the associated pusher 15. This deforms the associated rubber contact 13. The deformation of each rubber contact 13 electrically connects the contact portion 13*a* to a corresponding terminal (not shown) on the wiring board 11. When the button 17 is released from the pressure applied thereto, the resiliency of the rubber contact 13 returns the rubber contact 13 to its original shape. This separates the contact portion 13*a* of the rubber contact 13 from the terminal of the wiring board 11.

An elastic portion 13*b* is defined at the outer top portion of each rubber contact 13. The elastic portion 13*b* is formed integrally with the rubber contact 13 from the same material facing towards the associated projection 17*a* of the button 17. The elastic portion 13*b* has a concave recess facing towards the projection 17*a*. When the button 17 is pushed, the projection 17*a* contacts the associated elastic portion 13*b*. This elastically deforms the elastic portion 13*b*.

The elastic portion 13*b* of each rubber contact 13 is inserted through the hole 15*b* of the associated pusher 15. The elastic portion 13*b* extends from a contact surface 15*c* of the pusher 15, which is contacted by the associated projection 17*a* of the button 17. Thus, referring to FIG. 5, when the button 17 is pushed, one of the projections 17*a* contact the elastic portion 13*b* of the associated rubber contact 13 before the projection 17*a* contacts the contact surface 15*c* of the associated pusher 15.

Cutaway portions 17*b* are defined in the distal portion of each projection 17*a* of the button 17. Each cutaway portion 17*b* has a width W that is greater than the diameter of the elastic portion 13*b* of the associated rubber contact 13. When the button 17 is pushed by a predetermined amount, one of the projections 17*a* moves along the associated elastic portion 13*b* until the elastic portion 13*b* enters one of the cutaway portions 17*b*. This avoids contact between the button 17 and the rubber contacts 13.

The operation of the seesaw switch 1 will now be discussed.

Figure 5:
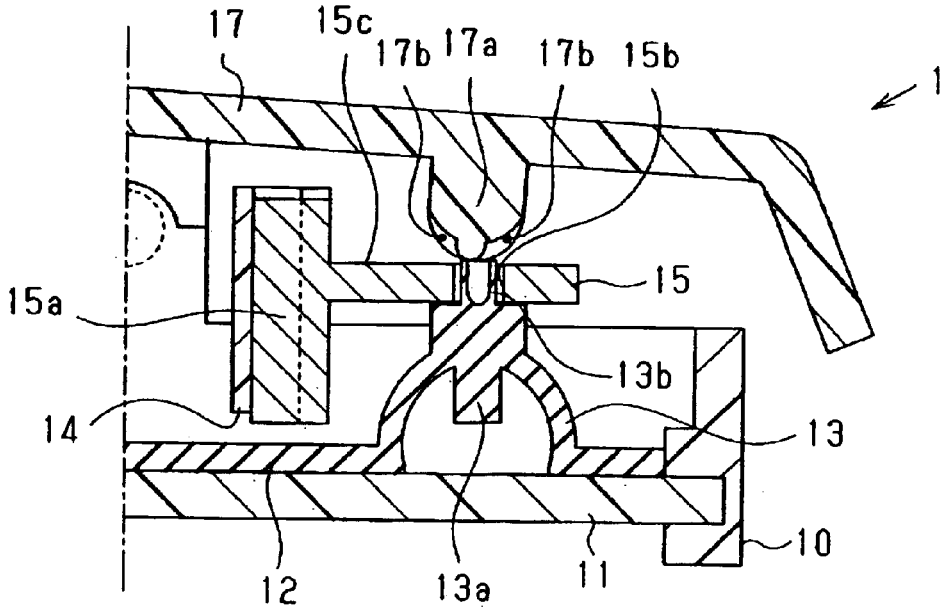
FIG. 5 is a cross-sectional view showing the operation of the seesaw switch of FIG. 3.
Figure 6:
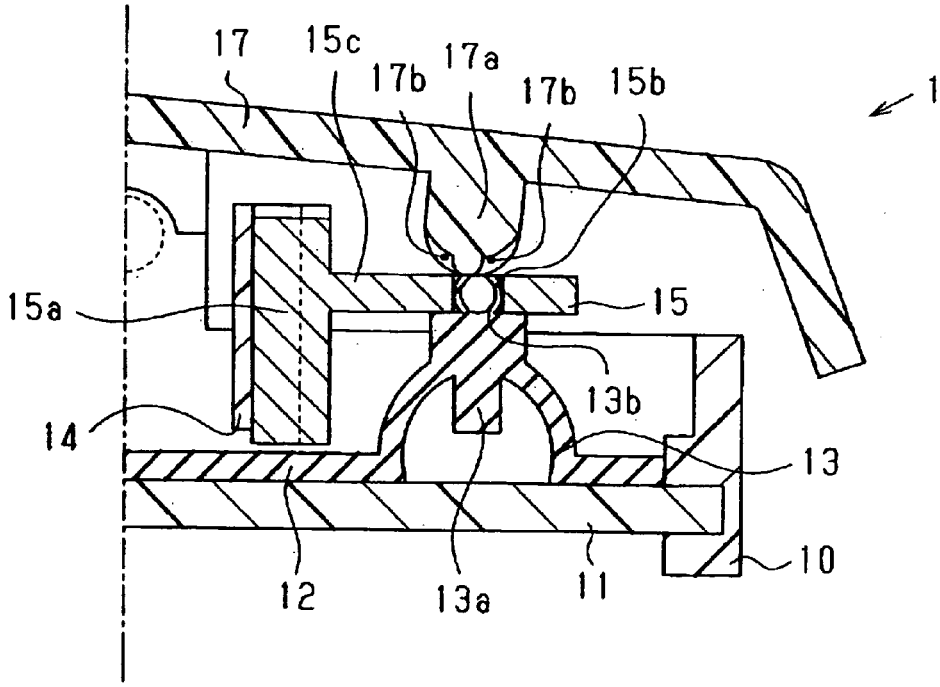
FIG. 6 is a cross-sectional view showing the operation of the seesaw switch following the state shown in FIG. 5.
Figure 7:
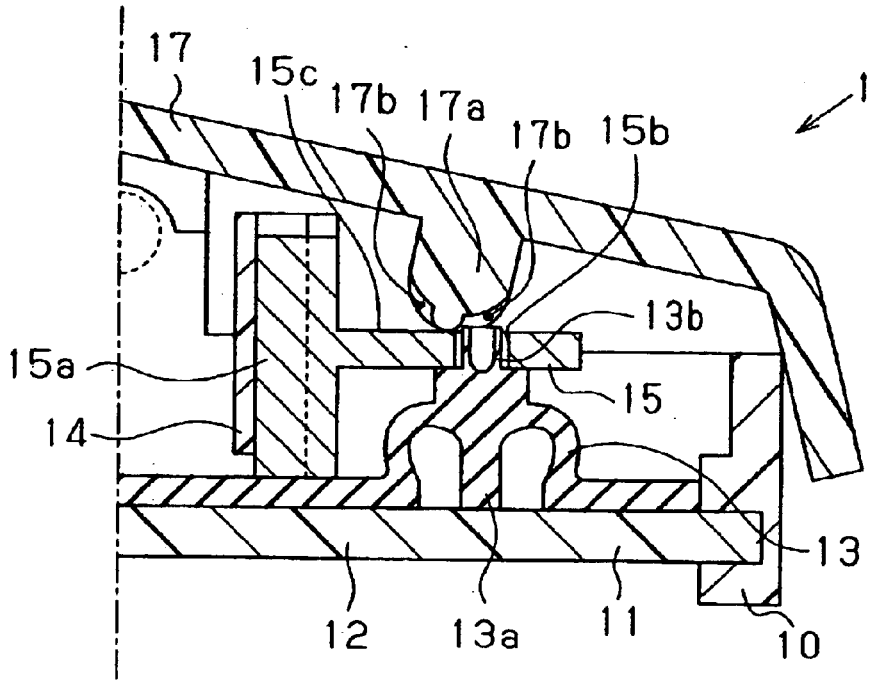
FIG. 7 is a cross-sectional view showing the operation of the seesaw switch following the state shown in FIG. 6.

Referring to FIG. 5, when one end (right end as viewed in FIG. 5) of the button 17 is pushed, the corresponding projection 17*a* comes into contact with the elastic portion 13*b* of the associated rubber contact 13. Then, referring to FIG. 6, the projection 17*a* pushes the associated pusher 15 while squeezing the elastic portion 13*b*. The projection 17*a* contacts the elastic portion 13*b* before contacting the pusher 15. This reduces the impact applied to the pusher 15 by the button 17.

Further pushing of the button 17 moves the distal portion of the projection 17*a* along the contact surface 15*c*. Subsequently, referring to FIG. 7, the distal portion of the projection 17*a* slips off the elastic portion 13*b* of the rubber contact 13. Thus, the elastic portion 13*b* enters the corresponding cutaway portion 17*b*. In this state, the elastic portion 13*b* does not contact the projection 17*a*, and the elastic portion 13*b* is returned to its original shape.

While the rubber contact 13 remains deformed, the contact portion 13*a* is connected with the corresponding terminal on the wiring board 11.

When the button 17 is released from the pressure applied thereto, the rubber contact 13 returns to its original shape due to its resiliency. This separates the contact portion 13*a* from the terminal of the wiring board 11. As a result, the seesaw switch 1 returns to its neutral position, which is shown in the state of FIG. 3.

The advantages of the seesaw switch 1 in the preferred embodiment will now be discussed.

(1) When the button 17 is pushed, one of the projections 17*a* contacts the elastic portion 13*b* of the associated rubber contact 13 before contacting the associated pusher 15. Thus, the impact applied to the pusher 15 by the projection 17*a* when the button 17 is pushed is absorbed by the contact between the projection 17*a* and the elastic portion 13*b*. This dampens noise that is produced when the button 17 comes into contact with the pusher 15.

(2) The elastic portion 13*b* of each rubber contact 13 projects from the contact surface 15*c* of the associated pusher 15. In this structure, when the button 17 is pushed, the corresponding projection 17*a* always contacts the elastic portion 13*b* before contacting the associated pusher 15. This ensures the dampening of noise that is produced when the button 17 comes into contact with the pusher 15.

(3) The elastic portion 13*b* of each rubber contact 13 has a concave recess. In this structure, the elastic portion 13*b* easily deforms when the associated projection 17*a* of the button 17 contacts the elastic portion 13*b*. Accordingly, when the button 17 contacts the pusher 15, the damping effect of the elastic portion 13*b* relative to the button 17 is improved. Further, the feel of the button 17 is also improved.

(4) The elastic portion 13*b* of each rubber contact 13 is formed integrally with the rubber contact 13. This decreases the quantity of parts and reduces the manufacturing cost.

(5) When the button 17 is pushed, one of the elastic portions 13*b* first comes into contact with the associated projection 17*a*. The projection 17*a* then moves along the elastic portion 13*b*. When the elastic portion 13*b* is in the corresponding cutaway portion 17*b*, the elastic portion 13*b* does not contact the projection 17*a*. Thus, after the impact produced between the button 17 and the pusher 15 is absorbed, a user may further push the button 17 with a relatively small force. This further improves the feel of the button 17.

It should be apparent to those skilled in the art that the present invention may be embodied in many other specific forms without departing from the spirit or scope of the invention. Particularly, it should be understood that the present invention may be embodied in the following forms.

Figure 8:
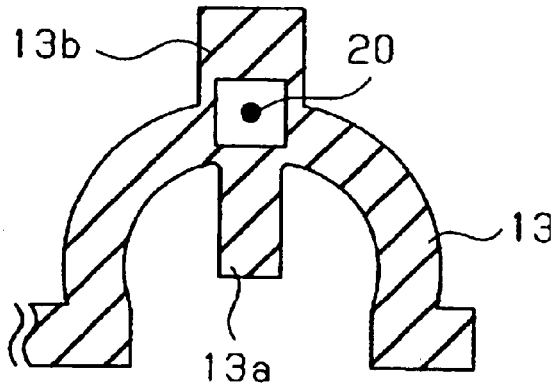
FIG. 8 is a cross-sectional view showing a rubber contact of a seesaw switch according to a further embodiment of the present invention.

Each elastic portion 13*b* does not necessarily have to be provided with the concave recess. For example, as shown in FIG. 8, a hollow portion 20 may be formed between the inner and outer sides of the top of each rubber contact 13. In this structure, when the button 17 is pushed, the part of the rubber contact 13 near the hollow portion 20 easily deforms.

Each projection 17*a* of the button 17 does not necessarily have to be provided with the cutaway portions 17*b*. In such a structure, each elastic portion 13*b* extends from the associated pusher 15. Thus, the projection 17*a* contacts the pusher 15 after contacting the elastic portion 13*b* in the same manner as in the preferred embodiment.

The present invention may be embodied in a switch other than the seesaw switch 1. For example, the present invention may be embodied in a push switch.

The present examples and embodiments are to be considered as illustrative and not restrictive, and the invention is not to be limited to the details given herein, but may be modified within the scope and equivalence of the appended claims.

What is claimed is:

1. A switch comprising:

a wiring board;

a resiliently deformable rubber contact arranged on the wiring board, the rubber contact including a contact portion electrically connected to the wiring board when the rubber contact is deformed;

a pusher for contacting and deforming the rubber contact; and an operating body for contacting the pusher when operated, wherein the rubber contact includes an elastic portion that contacts the operating body before the operating body contacts the pusher.

2. The switch according to claim 1, wherein the pusher includes a contact surface for contacting the operating body and a hole extending through the contact surface, and the elastic portion extends from the contact surface of the pusher through the hole facing towards the operating body.

3. The switch according to claim 1, wherein the elastic portion of the rubber contact includes a recess facing towards the operating body.

4. The switch according to claim 1, wherein the operating body includes a cutaway portion located at a position corresponding to the elastic portion so that the elastic portion first contacts the operating body when the operating body is operated and thereafter enters a state in which the operating body is not in contact with the elastic portion while the operating body is operated.

5. The switch according to claim 1, wherein the rubber contact is dome-shaped and includes an inner top portion and an outer top portion, the contact portion being arranged on the inner top portion of the rubber contact, and the elastic portion being arranged on the outer top portion, wherein the rubber contact includes a hollow portion defined between the contact portion and the elastic portion.

6. The switch according to claim 1, wherein the elastic portion is formed integrally with the rubber contact.

7. A switch comprising:

a wiring board;

a resiliently deformable rubber contact arranged on the wiring board, the rubber contact including a contact portion electrically connected to the wiring board when the rubber contact is deformed;

a pusher for contacting and deforming the rubber contact, the pusher including a contact surface; and an operating body for contacting the contact surface of the pusher when operated, wherein the rubber contact includes an elastic portion extending from the contact surface toward the operating body to contact the operating body before the operating body contacts the contact surface of the pusher.

8. The switch according to claim 7, wherein the rubber contact includes a thin portion for facilitating deformation of the elastic portion when contacting the pusher.

9. The switch according to claim 7, wherein the elastic portion of the rubber contact includes a recess facing towards the operating body.

10. The switch according to claim 7, wherein the elastic portion is formed integrally with the rubber contact.

* * * * *